US005259156A

United States Patent [19]

Ronen

[11] Patent Number: 5,259,156

[45] Date of Patent: Nov. 9, 1993

[54] GRINDING METHOD AND CLAMPING DEVICE

[75] Inventor: Mordechai Ronen, Herzliya, Israel

[73] Assignees: Engineers' Tool Manufacturing Company, Herzliya, Israel; Voumard Machines Co. S.A., Chaux-de-Fonds, Switzerland; part interest to each

[21] Appl. No.: 876,705

[22] Filed: Apr. 29, 1992

Related U.S. Application Data

[63] Continuation-in-part of Ser. No. 601,527, Oct. 23, 1990, abandoned.

[30] Foreign Application Priority Data

Feb. 23, 1990 [IL] Israel ..... 93515

[51] Int. Cl.[5] ..... B24B 5/06; B24B 41/06

[52] U.S. Cl. ..... 51/50 R; 51/290; 51/227 R; 51/236; 51/238 S; 82/150

[58] Field of Search ..... 51/290, 227 R, 277, 51/236, 237, 261, 50 R, 165.93, 291, 103 C; 82/250, 248

[56] References Cited

U.S. PATENT DOCUMENTS

| | | | |
|---|---|---|---|
| 811,684 | 2/1906 | Adams | 51/227 R |
| 2,011,091 | 8/1935 | Steinbauer | 51/261 |
| 2,390,888 | 12/1945 | Liber | 82/148 |
| 2,816,301 | 12/1957 | Hopkins | 51/227 R |
| 2,889,668 | 6/1959 | Gluchowicz et al. | 51/236 |
| 2,927,406 | 3/1960 | Terp | 51/236 |
| 3,136,102 | 6/1964 | Messerschmidt | 51/277 |
| 3,403,482 | 10/1968 | Rataiczak | 51/227 R |
| 3,557,492 | 1/1971 | Greenberg | 51/227 R |
| 3,754,747 | 8/1973 | Tateisi et al. | 51/237 R |

FOREIGN PATENT DOCUMENTS

| | | | |
|---|---|---|---|
| 0837564 | 6/1981 | U.S.S.R. | 82/150 |
| 0534102 | 2/1941 | United Kingdom | 82/150 |

*Primary Examiner*—Robert A. Rose
*Attorney, Agent, or Firm*—Jacobson, Price, Holman & Stern

[57] ABSTRACT

An auxiliary device is disclosed for use with grinding machines to assist in clamping a workpiece and performing the grinding of an internal bore in the workpiece. The device has an exteriorily conical surface extending from an annular projection to one end of the device which inserts into the workpiece and the interior of the device also has a frusto-conical surface tapering outwardly to the opposite end.

7 Claims, 2 Drawing Sheets

GRINDING METHOD AND CLAMPING DEVICE

This is a continuation-in-part of application Ser. No. 07/601,527, filed Oct. 23, 1990 now abandoned.

FIELD AND BACKGROUND OF INVENTION

The present invention relates to an auxiliary member for use in connection with grinding machinery and more particularly for grinding the internal bore, i.e. the lumen of hollow workpieces which are also of external circular cross-section.

As is well known, in grinding the internal circular surface of such a workpiece—which, in most cases, is intended to serve as a machine-part—it is of utmost importance that not only maximal precision is observed, but also that the internal longitudinal axis, i.e. that of the bore or lumen and that of the external circle coincide. It has been customary therefore to resort to different, but in all cases rather complicated clamping and centering means when attempting to grind the internal surface of such a workpiece on which the outer grinding had already been done. Obviously, for each of the operations, the external grinding and the internal grinding, the workpiece had to be centered and clamped separately, hence the difficulty in obtaining the required precision of work and required concentricity.

Furthermore, it is common for all the different systems to clamp the workpiece to the revolving cam of the grinding machine, the outside diameter of which workpiece has already been ground, this being done to secure the necessary concentricity and precision runout between the inside and outside diameters.

OBJECTS OF INVENTION

It is an object of the present invention to provide an auxiliary device to be fitted on an internal grinding machine permitting the performance of grinding operations on a workpiece of the type referred to above, without separately centering it for the external and the internal operations.

It is a further object of the invention to reduce the cost of the grinding by eliminating repeated clamping and centering and employment of complicated clamping and centering means and costly equipment therefor.

ADVANTAGES OF THE INVENTION

The system and device according to the invention is a new concept of clamping, driving and grinding for internal grinding machines where the system makes it possible to clamp and drive the workpiece on an internal grinding machine between two dead centers on the workpiece's axis as is known and used in outside grinding operations or other machining processes.

The possibility of clamping and driving the workpiece between its two centers on the workpiece axis as it is used in outside diameter operation makes it possible to use the same basis and datum point for all grinding operations and, of course, creates or ensures the utmost precision and achieves the best run out between outside diameter and inside diameter which is very important in precision grinding.

It also gives the user flexibility in the order of operation, as it is no longer important whether the outer or inner diameter operations are performed first.

The advantage of employing the new auxiliary device resides therein, that it permits the use of the same base and data point for the two grinding operations and as a consequence to attain precision and coincidence of the central axes of the two circles ascribing the outer periphery and that of the lumen of the workpiece.

A further advantage of the use of the auxiliary device is the fact that an operator is free to attend to the external surface of the workpiece first and then to the internal wall of the bore, or vice versa.

Yet a further advantage of the use of the auxiliary device will reduce substantially operation costs by eliminating many different special and complicated clamping chucks and accessories.

The new system is based on "hollow conical center ring" which is used to clamp the workpiece on one end or side and a dead center on the other end or side of the workpiece with different driving rings or fingers to drive the workpiece.

The "hollow conical center ring", which is mounted in a steady rest on the internal grinding machine table, aligned and centered with the machine workpiece driving center, clamps the workpiece by using the internal bore to be ground as a center point, while still making it possible to perform internal grinding on the inner diameter through the "hollow conical center ring". A recess should be ground on the cone of the "hollow conical center ring" with the internal grinding wheel for which the diameter is never more than two thirds of the workpiece bore to be ground, leaving at least two thirds of the cone of the "hollow conical center ring" for the workpiece clamping and making it possible to clamp the workpiece with enough rigidity to perform the necessary precision grinding operation.

This system is applicable to most of the existing internal grinding machines by simple adaptors and it also can be used in light and precision bore turning operations on the lathes and other machines.

SUMMARY OF INVENTION

According to the invention the new device consists of an at least partly exteriorily conical ring having an external circumferentially extending flange or ridge, such that the axial cross section of the said conical portion is that of a frustum of a cone.

In a practical embodiment the internal wall of the ring also ascribes a frustum of a cone.

In a preferred embodiment a recess is provided on the internal wall of the new ring device extending up to about one third of the circumference of the circular internal wall of the device (i.e. up to about 120°).

In practice, the extension of the arcuate recess will be about 30°, the said recess serving to facilitate the introduction of a grinding wheel into the internal space of the device.

In practice, the ring, which rests on a steadying support is introduced with the smaller circumferential edge of the frustum into the lumen of the workpiece whose opposite end is turnably held by a dead-center of the machine and is in driving contact with an appropriately driving ring and finger.

DESCRIPTION OF DRAWINGS

The invention will now be described with reference to the annexed drawings, wherein.

DETAILED DESCRIPTION OF INVENTION

Figures 1, 2, 3:
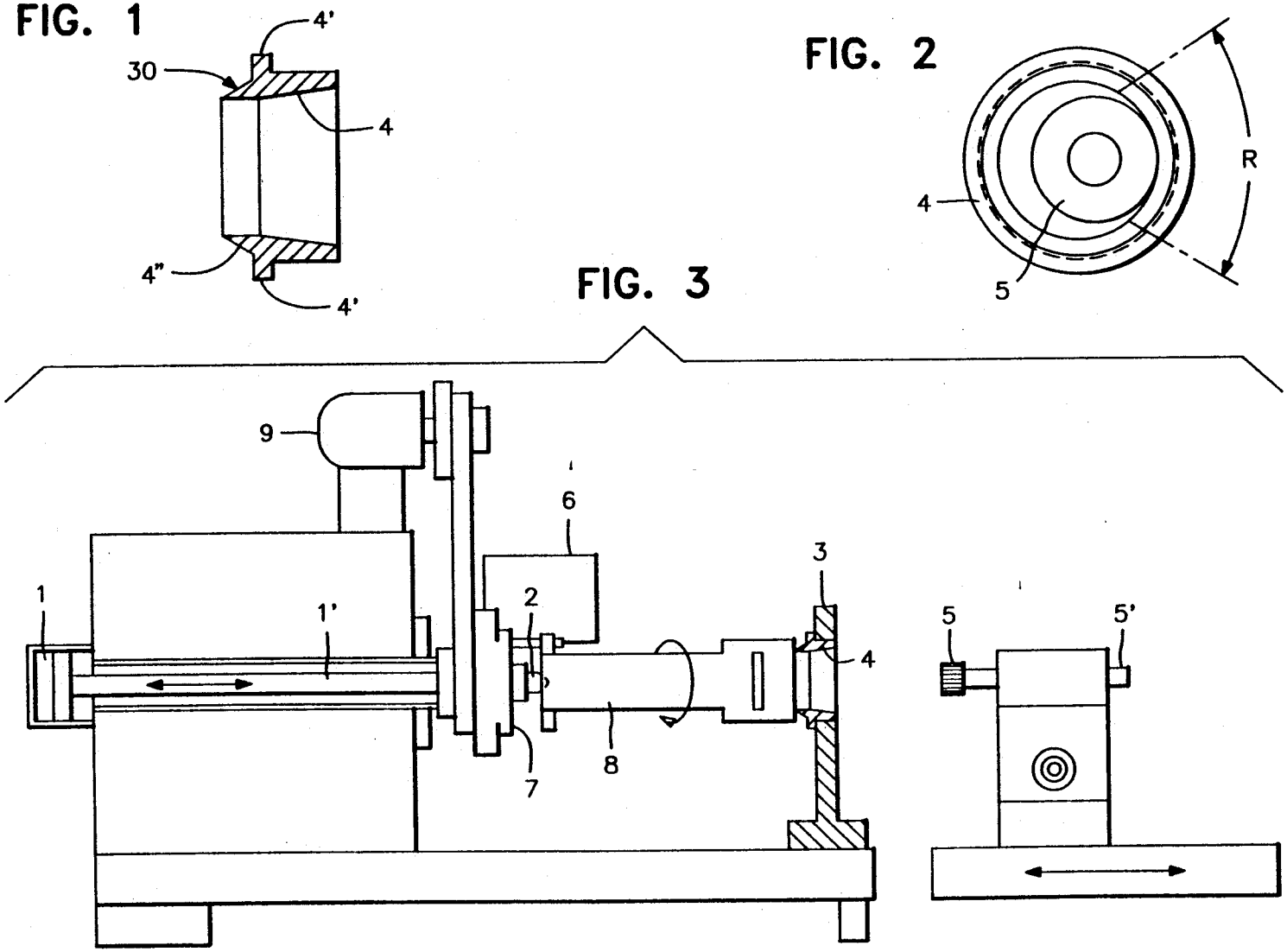
FIG. 1 is an axial sectional view of the new device.
FIG. 2—an end-view thereof, indicating also a grinding wheel within the confines of the inside lumen of the workpiece.
FIG. 3 is a schematic view of a lathe-like grinding machine, with the new device in operational position thereon.

The machine comprises in a conventional manner, a chucking cylinder 1, which includes a shaft 1', terminating in dead center 2. There is provided a transmission gear 7 and a driving mechanism 6 for imparting rotational movement to a workpiece 8. The necessary drive is provided by an electric motor 9. All these parts and their function is known and requires no further detailed description.

The new device shown in FIGS. 1 and 2 consists of a partly frustoconically shaped ring 4 which is surrounded by a circumferential ridge 4' positioned intermediate the two end edges of the ring. The frusto-conical portion marked 4" of ring 4 extends on the forward part of the ring and is delimited by the ridge 4'. As can be seen in FIG. 1, the smaller peripheral end edge of the frusto-conical portion 4" of ring 4 enters the circular lumen of the workpiece, the ring being safely supported on a steadying support 3.

In a conventional way the grinding wheel 5 fixed on a spindle 5' and driven in a generally known way is carried with its drive on a hydraulical table and can be brought to enter the interior of the workpiece to be ground, traversing the inner space of ring 4.

To facilitate the introduction of the grinding wheel into grinding engagement with the interior bore of the workpiece, a portion of the internal wall of the auxiliary member is recessed by grinding (or otherwise) an arcurate recess extending along not more than about a third (120°) of the inner circular wall of the auxiliary member; the said recess indicated by the letter R in FIG. 2 will in practice extend over an arc of about 30°.

Figure 4:
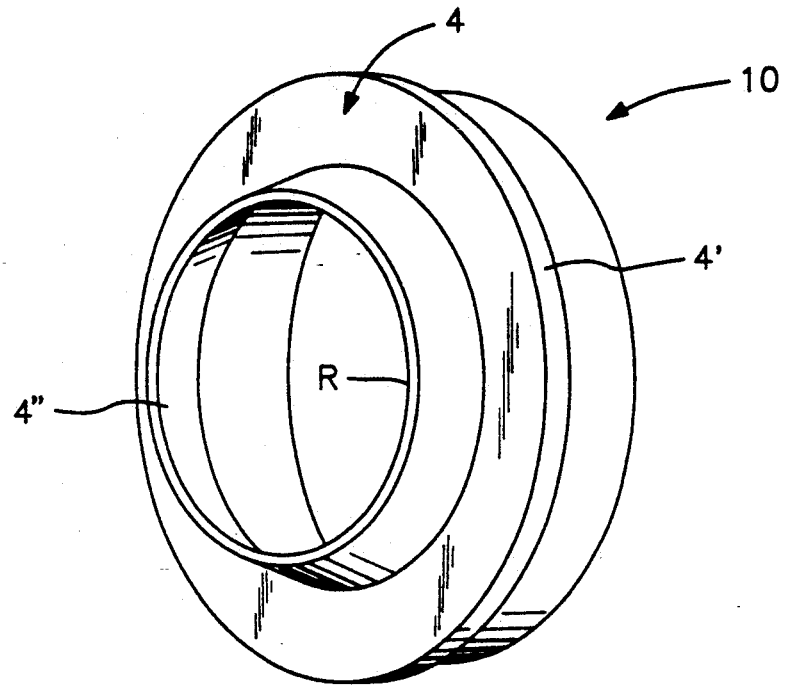
FIG. 4 is a perspective view of a device of the invention.
Figure 5:
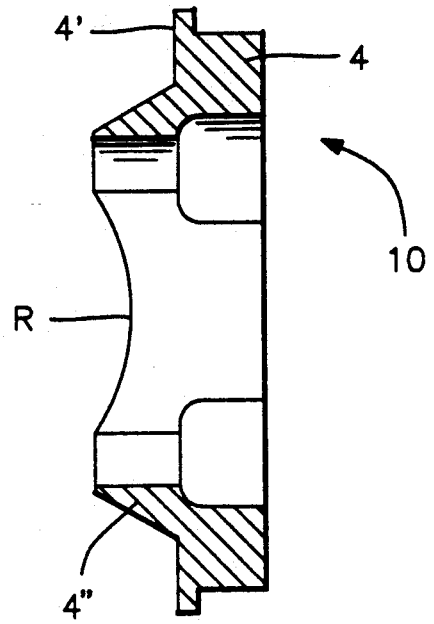
FIG. 5 is a cross-sectional view of the device of FIG. 4.

FIG. 4 illustrates the new device, in perspective, and FIG. 5 shows a section therethrough, particularly emphasizing recess R, also shown in FIG. 2. As discussed above, recess R facilitates entry of grinding wheel 5 into the interior of the workpiece to be ground. Grinding wheel 5 passes through ring 4 to grind the workpiece through recess R in frusto-conical portion 4", the edge of which is entered into the circular lumen of the workpiece. The auxiliary member 10 (which is the new device) rests in stationary position in support 3 with end 4" entered into workpiece 8. The workpiece 8 is rotated while its interior surface is ground using grinding wheel 5.

I claim:

1. An auxiliary member for use as a rotationally stationary support for a workpiece in grinding the internal bore of a rotatably driven workpiece in a grinding machine, said member comprising an annular ring having an external circumferentially extending projection dividing the ring into a first end portion for engaging a support and a second end portion for entering the bore in the workpiece, such that the axial cross section of the second end portion is that of a frustum of a cone tapering inwardly from said projection toward one end of the ring said auxiliary member having an arcuate recess formed in and extending around a portion of an internal circumferential wall of said ring to facilitate introduction of a grinding wheel into the internal space of the auxiliary member.

2. The member claimed in claim 1, wherein the internal wall of the ring also ascribes a frustum of a cone tapering outwardly toward an opposite end of the ring to guide a grinding tool.

3. The member claimed in claim 1, characterised thereby that the said recess extends over a substantial portion of the circumference of the circular internal wall of the ring.

4. The member claimed in claim 1 in combination with a support of a grinding machine, the grinding machine also including a chuck for holding a hollow cylindrical workpiece at one end of the workpiece while an opposite end of the workpiece is rotationally supported by said member, and a grinding tool for engaging bore of the workpiece through said member.

5. In combination, a grinding machine having a driven mechanism supporting one end of a workpiece having a cylindrical bore, said driven mechanism rotating the workpiece about the longitudinal axis of the bore and a grinder movable into grinding engagement with the interior surface of the bore in the workpiece through the other end of the workpiece, the improvement comprising a rotationally stationary auxiliary member engaging the other end of the workpiece, means supporting said auxiliary member in axial alignment with said bore in the workpiece, said auxiliary member comprising an annular ring having a bore therethrough through which the grinder may pass axially, said annular ring having one end portion telescoped into said bore in the workpiece, the external surface of said one end portion of said ring being frusto-conical to center said one end of said ring with respect to said bore in the workpiece when engaged therewith and during rotation of the workpiece in relation to said ring, the external surface of said ring inwardly of said frusto-conical portion being supported by said support means.

6. The combination as defined in claim 5 wherein said bore through said annular ring is defined by an internal surface extending therethrough and receiving said grinder, said internal surface including an arcuate recess extending inwardly from the smaller end of said frusto-conical external surface of said one end portion of said ring whereby the portion of the smaller end of the frusto-conical external surface having the recess therein will terminate longitudinally inwardly of the remaining portion of the smaller end of the frusto-conical external surface to provide the grinder access through the recess to the internal surface of the cylindrical bore in the workpiece to enable grinding said internal surface during rotation of the workpiece.

7. The combination as defined in claim 6 wherein the external surface of said ring includes a peripheral flange intermediate end portions thereof for engagement with said support means.

* * * * *